US008939193B2

(12) United States Patent
Stoyanov et al.

(10) Patent No.: US 8,939,193 B2
(45) Date of Patent: Jan. 27, 2015

(54) METHOD AND APPARATUS FOR FILTERED AND CONTROLLED FLOW METAL MOLDING

(76) Inventors: Peio Todorov Stoyanov, Woodland Hills, CA (US); Ching-Lung Wang, Taipei (TW)

( * ) Notice: Subject to any disclaimer, the term of this patent is extended or adjusted under 35 U.S.C. 154(b) by 1600 days.

(21) Appl. No.: 12/733,199

(22) PCT Filed: Aug. 22, 2007

(86) PCT No.: PCT/US2007/018609

§ 371 (c)(1),
(2), (4) Date: Nov. 13, 2012

(87) PCT Pub. No.: WO2008/024425

PCT Pub. Date: Feb. 28, 2008

(65) Prior Publication Data

US 2013/0068413 A1 Mar. 21, 2013

Related U.S. Application Data

(60) Provisional application No. 60/839,853, filed on Aug. 23, 2006.

(51) Int. Cl.
*B22D 43/00* (2006.01)
*B22D 18/04* (2006.01)

(52) U.S. Cl.
CPC ..... *B22D 18/04* (2013.01); *B22D 43/004* (2013.01)
USPC ..... 164/134; 164/358

(58) Field of Classification Search
CPC ..... B22C 9/086; B22D 43/004
USPC ..... 164/134, 358, 412
See application file for complete search history.

(56) References Cited

U.S. PATENT DOCUMENTS

| | | | | |
|---|---|---|---|---|
| 4,154,289 | A * | 5/1979 | Jeanneret | 164/358 |
| 4,928,746 | A * | 5/1990 | Butler et al. | 164/362 |
| 5,310,098 | A * | 5/1994 | Edwards | 222/591 |
| 5,913,353 | A * | 6/1999 | Riley et al. | 164/113 |
| 6,289,969 | B1 * | 9/2001 | Outten et al. | 164/134 |
| 7,201,212 | B2 * | 4/2007 | Bullied et al. | 164/516 |
| 2011/0042030 | A1 * | 2/2011 | Marcelino | 164/76.1 |

* cited by examiner

*Primary Examiner* — Kevin P Kerns
(74) *Attorney, Agent, or Firm* — Jack Jmaev

(57) ABSTRACT

Method and apparatus for flowing molten metal substantially vertically into a mold by means of a feeder tube while concurrently impeding the flow of oxides that collect at the perimeter of the head of the feeder tube. This reduces inclusions in the molten metal and improves the quality of a molded component as the molten metal solidifies.

4 Claims, 6 Drawing Sheets

METHOD AND APPARATUS FOR FILTERED AND CONTROLLED FLOW METAL MOLDING

RELATED APPLICATIONS

The present application claims priority to U.S. Provisional Application Ser. No. 60/839,853, entitled "Method and Apparatus for Filtered and Controlled Flow Metal Molding" by Stoyanov et al, and which was filed on Aug. 23, 2006.

BACKGROUND

In the past, metal molding relied on filling a cavity with molten metal and then allowing the metal to cool. A feeder tube is used to direct the molten metal into the cavity. Unfortunately, oxides form as a result of exposure of the molten metal to the material comprising the feeder tube. These oxides then find their way into the mold cavity along with the desired alloy. This causes an undesired effect in the resultant molded part in that the oxides weaken the final molded component.

Another problem that has not yet been addressed is that the flow of molten metal into the feeder tube is not controlled. Turbulent flow of the metal causes voids in the final molded part, again weakening its structural characteristics.

BRIEF DESCRIPTION OF THE DRAWINGS

Several alternative embodiments will hereinafter be described in conjunction with the appended drawings and figures, wherein like numerals denote like elements, and in which.

DETAILED DESCRIPTION

Figure 1:
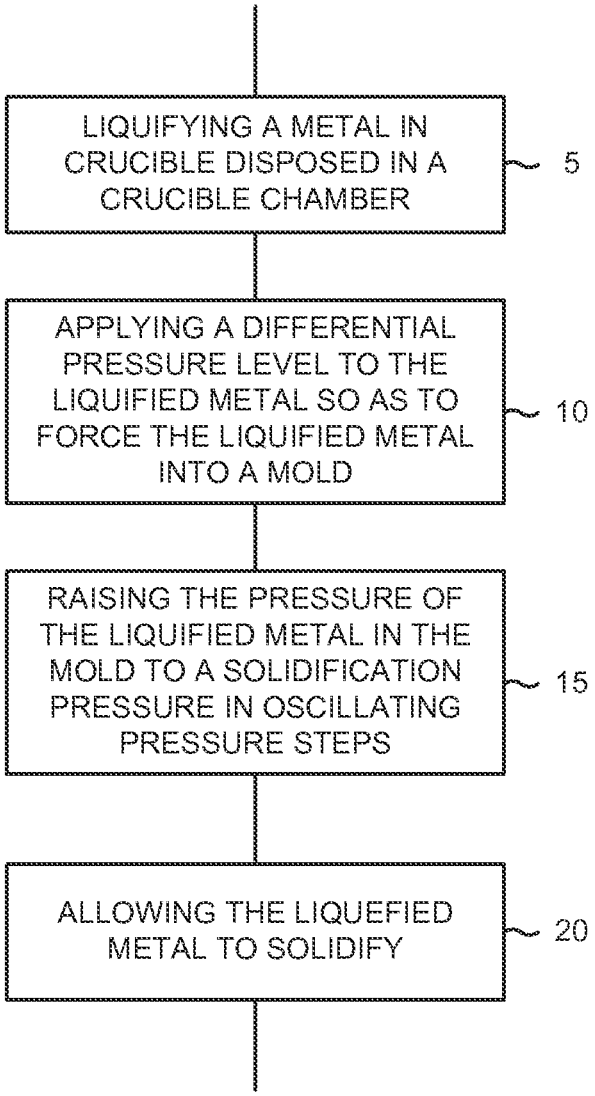
FIG. 1 is a flow diagram that depicts one example method for forming a casting.

FIG. 1 is a flow diagram that depicts one example method for forming a casting. According to this example method, the casting is formed by flowing molten metal substantially vertically into a mold by means of the feeder tube (step 5). The oxides that are collected at the perimeter of the head of the feeder tube are impeded in their flow (step 10) according to this example method. And inclusions in the molten metal are also reduced (step 15). The molten metal is then allowed to solidify (step 20). In one alternative example method, these process steps are accomplished in a manner where the chemistry of a molding material, for example an aluminum alloy, is not appreciably changed by the introduction of impurities to the molten metal. It can be appreciated that the present method may be applied in a vertical casting process that employees either vacuum, low-pressure or counter pressure molding. The scope of the claims appended hereto is to include this example method and variations thereof and an article of manufacture produced according to the teachings of the present method.

Figure 1A:
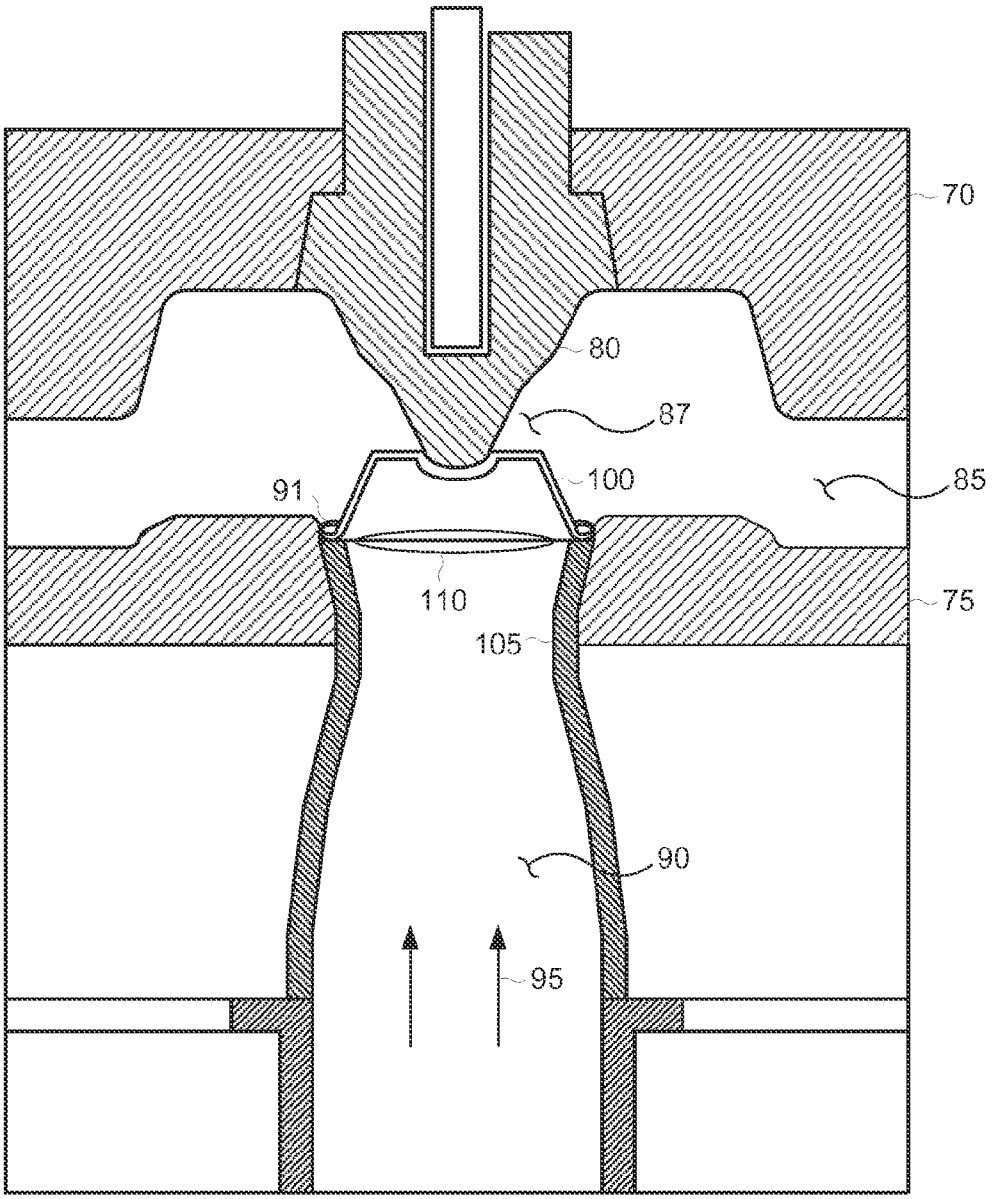
FIG. 1A is a pictorial representations of a molding machine that illustrates application of the present method.

FIG. 1A is a pictorial representation of a molding machine that illustrates application of the present method. In this example embodiment of a molding machine, the molding machine comprises an upper mold 70 and a lower mold 75. A divider 80 projects into a mold cavity 85 from the upper mold 70. The lower mold 75 is substantially concentric about a feeder tube 90. In operation, molten metal is directed upwards 95 though the feeder tube into the mold cavity 85. It should also be appreciated that, as the molten metal is directed outward 95 through the feeder tube 90, contact between the molten metal and an inner surface 105 of the feeder tube induces the formation of oxides within the molten metal. The top portion of the feeder tube 90 is typically referred to as the head 110 of the feeder tube 90. Generally, these oxides are more prevalent about the perimeter of the feeder tube as the molten metal flows upward there through.

Figure 2:
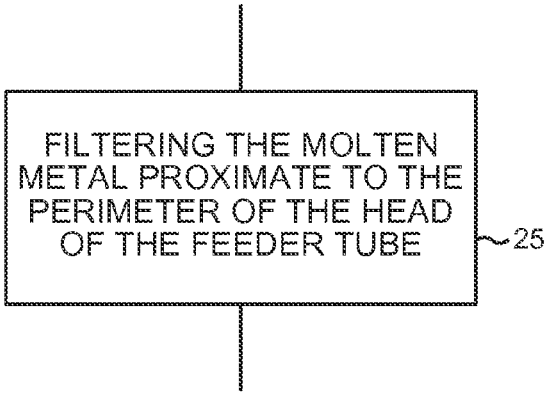
FIG. 2 is a flow diagram that depicts one alternative method for impeding the flow of oxides that collect at the perimeter of the head of the feeder tube.

FIG. 2 is a flow diagram that depicts one alternative method for impeding the flow of oxides that collect at the perimeter of the head of the feeder tube. According to this alternative method, the flow of oxides is impeded by filtering the molten metal proximate to the perimeter of the head of the feeder tube (step 25). Referring again to FIG. 1A, one application of the present method provides for introducing a filter 100 on top of the feeder tube 90. The filter 100 rests on a perimeter lip 91 of the feeder tube 90. The filter 100 is held in place by the divider 80 as a divider and the upper mold 70 are collectively moved downward toward the bottom mold.

Figure 3:
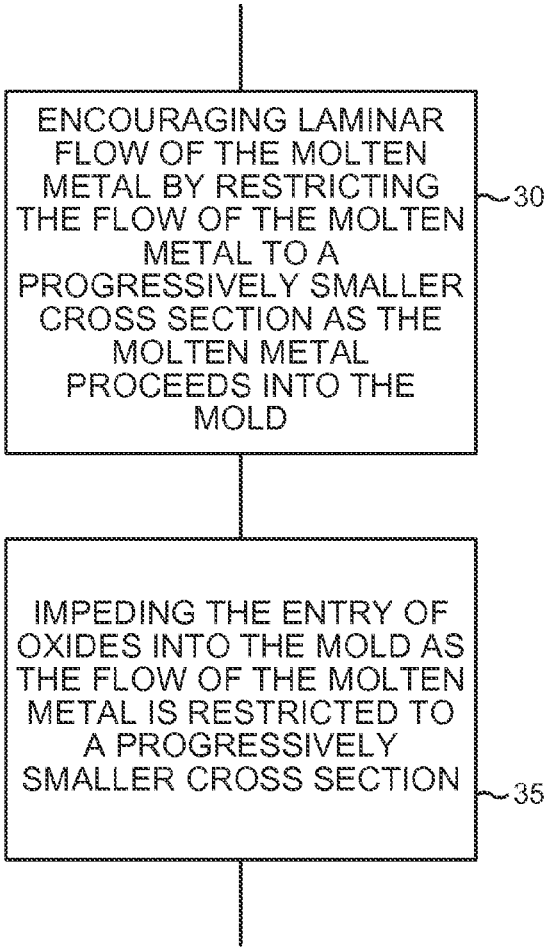
FIG. 3 is a flow diagram that depicts one alternative method for reducing inclusions in the molten metal.

FIG. 3 is a flow diagram that depicts one alternative method for reducing inclusions in the molten metal. According to this alternative example method, inclusions in the molten metal are reduced by encouraging laminar flow of the molten metal by restricting the flow of the molten metal to a progressively smaller cross section as the molten metal proceeds into the mold (step 30). In one variation of the present method, this is accomplished by introducing a filter 100 having a substantially conical shape. This conical shape promotes yet another aspect of this alternative variation of the present method whereby the progressively smaller cross section impedes the entry of oxides into the mold cavity (step 35) formed between the upper mold 70 and bottom mold 75.

Figure 4:
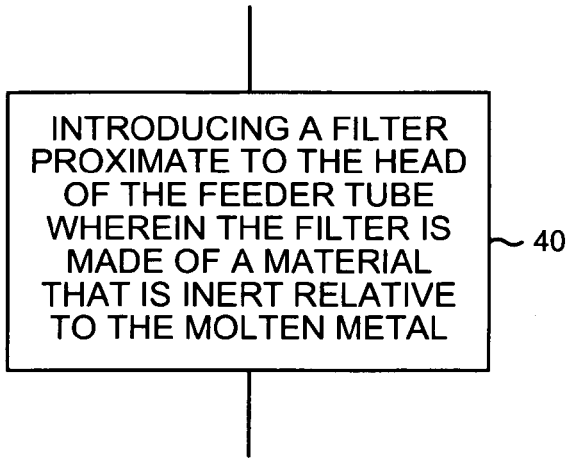
FIG. 4 is a flow diagram that depicts an alternative method for filtering which substantially prevents introduction of impurities into a molten material.

FIG. 4 is a flow diagram that depicts an alternative method for filtering which substantially prevents introduction of impurities into a molten material. As already discussed, the method steps described herein, according to one variation of the present method, are accomplished in a manner whereby the chemistry of the molten material is not altered in any significant manner. As such, this variation of the present method provides for introducing a filter proximate to head of the feeder tube wherein the filter is made of a material that is inert relative to the molten metal (step 40). It should be appreciated that any material which is resistant to reaction with the molten material may be used. For example, a fiber material may be used. A fiberglass material may also be used. A wide variety of materials may be used so long as a filter itself maintains a shape when subjected to the temperatures involved in process of flowing molten metal through the feeder tube 90 into the mold cavity 85. In one alternative method, the filtering is accomplished at a temperature of at least 800 C.

Figure 5:
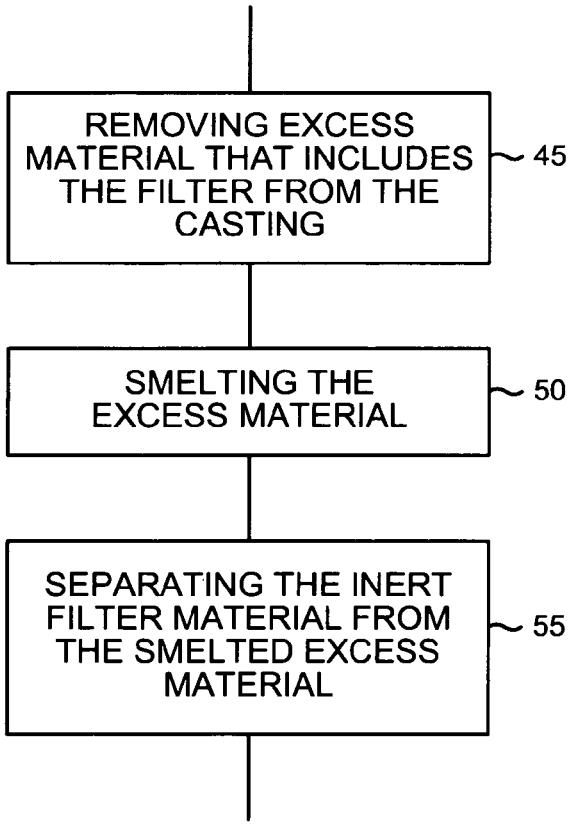
FIG. 5 is a flow diagram that depicts an alternative variation of the present method that promotes recycling of excess material from a molded part.

FIG. 5 is a flow diagram that depicts an alternative variation of the present method that promotes recycling of excess material from a molded part. FIG. 1A illustrates that the mold cavity 85 may have residual material 87 proximate to center of the mold cavity 85. Accordingly, it will be highly beneficial to recycle this residual material 87. According to prior art, any impurities found in the residual material would render it impractical, or economically infeasible to recover the residual material 87. According to the present method, the excess material 87 is substantially free of impurities by virtue of the fact that, according to this variation of the present method, the filter 100 introduced at the head 110 of the feeder tube 90 comprises a material that is inert relative to the molten metal. But really, this variation of the present method provides for removing the excess material that includes the filter made of inert material from the casting (step 45). The excess material is then smelted (step 50). Through a process of degassing, the inert filter material is then separated from the excess material (step 55).

Figure 6:
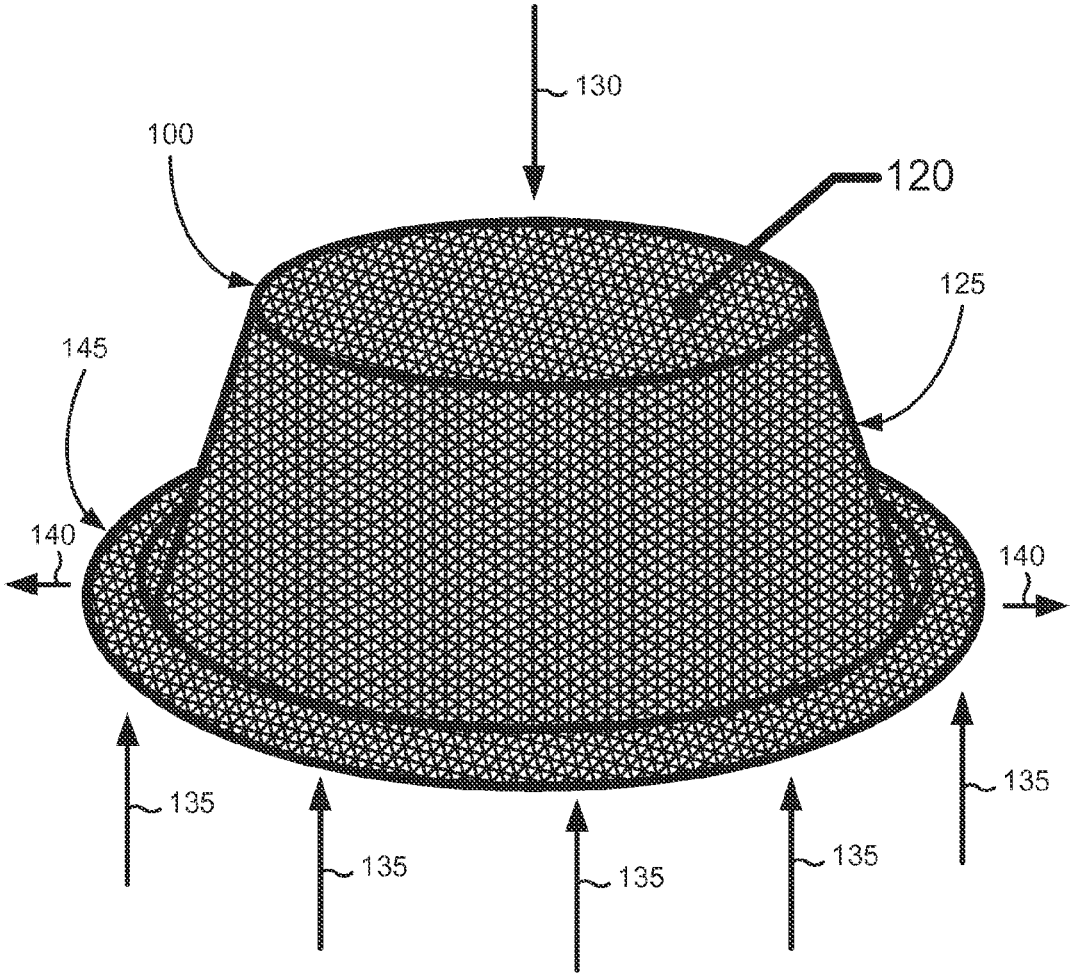
FIG. 6 is a pictorial diagram that illustrates one example embodiment of a filter.

FIG. 6 is a pictorial diagram that illustrates one example embodiment of a filter. According to this example embodiment, a filter 100 comprises a mesh sheet that is stamped into a substantially conical shape having sloped sides 125 with a flat top section 120. At the bottom perimeter of the conical shape, the mesh sheet is curled upward to form a rim 145. When the filter 100 is used, the rim 145 is disposed on the periphery of a feeder tube included in a mold. In order to hold the filter in place, a force 130 is applied downward substantially at the center of the flat top section 120. Due to the conical shape of the filter, the bottom perimeter of the filter will tend to expand (i.e. force 140). This expansion is resisted by the form of the rim 145. Accordingly, upward force 135 is applied by the support of the perimeter of the feeder tube. In one alternative embodiment, the mesh sheet comprises a fiber material. In yet another alternative embodiment, the mesh sheet comprises a material that is inert relative to the material to be molded. In yet another alternative embodiment, the mesh sheet comprises a material that can withstand molding temperatures of at least 800 C without melting or otherwise losing much of its form, i.e. substantially maintains its shape in these operating temperatures.

Figure 6A:
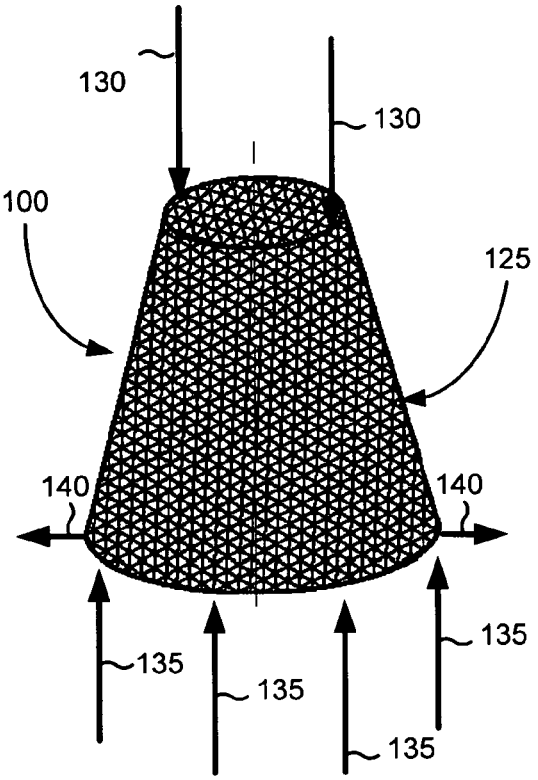
FIGS. 6A and 6B are pictorial diagrams that illustrate another illustrative embodiment of a filter.
Figure 6B:
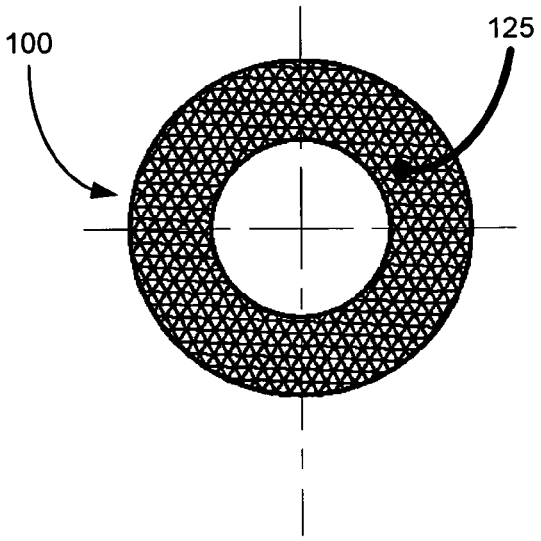

FIGS. 6A and 6B are pictorial diagrams that illustrate another illustrative embodiment of a filter. According to this example embodiment, a filter 100 comprises a mesh sheet formed into a substantially conical shape having sloped sides 125. In order to hold the filter in place, a force 130 is applied downward substantially at the top of the filter. Due to the conical shape of the filter, the bottom perimeter of the filter will tend to expand (i.e. force 140) against the inside of the feeder tube included in a mold assembly. An upward force 135 is applied by the support of the perimeter of the feeder tube. In one alternative embodiment, the mesh sheet comprises a fiber material. In yet another alternative embodiment, the mesh sheet comprises a material that is inert relative to the material to be molded. In yet another alternative embodiment, the mesh sheet comprises a material that can withstand molding temperatures of at least 800 C without melting or otherwise losing much of its form, i.e. substantially maintains its shape in these operating temperatures.

While the present method and apparatus has been described in terms of several alternative and exemplary embodiments, it is contemplated that alternatives, modifications, permutations, and equivalents thereof will become apparent to those skilled in the art upon a reading of the specification and study of the drawings. It is therefore intended that the true spirit and scope of the claims appended hereto include all such alternatives, modifications, permutations, and equivalents.

What is claimed is:

1. A method for forming a casting comprising:

flowing molten metal substantially vertically into a mold by means of a feeder tube;

impeding the flow of oxides that collect at the perimeter of the head of the feeder tube by directing the molten metal through a filter disposed proximate to the end of the feeder tube, wherein said filter has a conical shape and protrudes into a mold cavity of the mold and is held in position by a counter force provided by a divider that protrudes from an opposite side of the mold cavity;

reducing inclusions in the molten metal by inducing laminar flow of the molten metal as it moves through said filter; and allowing the molten metal to solidify.

2. The method of claim 1 wherein impeding the flow of oxides that collect at the perimeter of the head of the feeder tube comprises filtering the molten metal proximate to the perimeter of the head of the feeder tube.

3. The method of claim 1 wherein inducing laminar flow in the molten metal comprises:

restricting the flow of the molten metal to a progressively smaller cross section as the molten metal proceeds into the mold.

4. The method of claim 1 wherein impeding the flow of oxides and reducing inclusions in the molten metal is accomplished by introducing a filter proximate to the head of the feeder tube wherein the filter is made of a fiberous material that is inert relative to the molten metal and further comprising:

removing excess material that includes the filter from the casting;

smelting the excess material; and separating the inert filter material from the smelted excess material.

* * * * *